US011096439B2

(12) United States Patent
King et al.

(10) Patent No.: US 11,096,439 B2
(45) Date of Patent: Aug. 24, 2021

(54) PROTECTIVE HELMET HEADBAND FOR ACCOMMODATING MULTIPLE HEAD SIZES AND/OR SHAPES

(71) Applicant: E.D. Bullard Company, Cynthiana, KY (US)

(72) Inventors: Matthew King, Lexington, KY (US); Matthew G. Plunkett, Lexington, KY (US); Nathan E. Robinson, Lexington, KY (US); Joshua J. M. Haldeman, Cincinnati, OH (US)

(73) Assignee: E.D. Bullard Company, Cynthiana, KY (US)

( * ) Notice: Subject to any disclaimer, the term of this patent is extended or adjusted under 35 U.S.C. 154(b) by 149 days.

(21) Appl. No.: 16/653,450

(22) Filed: Oct. 15, 2019

(65) Prior Publication Data

US 2020/0121014 A1 Apr. 23, 2020

Related U.S. Application Data

(60) Provisional application No. 62/747,746, filed on Oct. 19, 2018.

(51) Int. Cl.
*A42B 3/14* (2006.01)
*A42B 3/08* (2006.01)

(52) U.S. Cl.
CPC ..... *A42B 3/08* (2013.01)

(58) Field of Classification Search
CPC .. A42B 3/08; A42B 3/145; A42B 3/14; A42B 1/02
See application file for complete search history.

(56) References Cited

U.S. PATENT DOCUMENTS 2,511,234 A * 6/1950 Anderson ..... A42B 3/145 2/8.1
3,090,046 A * 5/1963 Bowers, Sr. ..... A61F 9/06 2/8.1
3,444,560 A * 5/1969 Northup, Jr. ..... A42B 3/145 2/8.1

(Continued)

FOREIGN PATENT DOCUMENTS

JP 06-002208 A 1/1994
KR 20-0280751 Y1 7/2002
KR 20-0291882 Y1 10/2002

OTHER PUBLICATIONS

3M Speedglas Welding Safety Catalog 2018.

(Continued)

*Primary Examiner* — Tajash D Patel
(74) *Attorney, Agent, or Firm* — Sites & Harbison, PLLC; David W. Nagle, Jr.

(57) ABSTRACT

A headband for a protective helmet comprises a front portion configured to be secured to the protective helmet; a left rear portion that is selectively connected to the front portion; a right rear portion that is selectively connected to the front portion and is configured to overlap the left rear portion; and a means for securing a position of the left rear portion relative to the right rear portion, such as a ratchet mechanism. A headband kit includes multiple left rear portions, each of which can be selectively connected to the front portion, and multiple right rear portions, each of which can be selectively connected to the front portion.

17 Claims, 4 Drawing Sheets

(56) References Cited

U.S. PATENT DOCUMENTS

| | | | | |
|---|---|---|---|---|
| 4,888,831 | A | 12/1989 | Oleson | |
| 5,950,245 | A * | 9/1999 | Binduga | A42B 3/145 2/417 |
| 6,032,297 | A * | 3/2000 | Barthold | A42B 3/10 2/416 |
| 6,314,588 | B1 * | 11/2001 | Fang | A42B 3/145 2/183 |
| 6,609,254 | B2 | 8/2003 | Bielefeld et al. | |
| 6,862,747 | B2 | 3/2005 | Oleson | |
| 7,000,262 | B2 | 2/2006 | Bielefeld | |
| 7,043,772 | B2 | 5/2006 | Bielefeld et al. | |
| 7,174,575 | B1 * | 2/2007 | Scherer | A42B 3/145 2/418 |
| 7,213,271 | B1 | 5/2007 | Bielefeld | |
| 8,161,576 | B2 * | 4/2012 | Lemke | A42B 3/145 2/418 |
| 2015/0143669 | A1 | 5/2015 | Pereira et al. | |

OTHER PUBLICATIONS

3M Speedglas 9100 Welding Headband 2020. https://www.3m.com/3M/en_US/company-us/all-3m-products/~/3M-Speedglas-9100-Welding-Headband-06-0400-51-37179-AAD-Assembled-Parts-1-EA-Case/?N=5002385+3294755344&preselect=3293786499&rt=rud (downloaded Jan. 31, 2020).

Korean Intellectual Property Office, International Search Report issued in corresponding Application No. PCT/US2019/056438, dated Feb. 5, 2020.

* cited by examiner

PROTECTIVE HELMET HEADBAND FOR ACCOMMODATING MULTIPLE HEAD SIZES AND/OR SHAPES

CROSS-REFERENCE TO RELATED APPLICATIONS

The present application claims priority to U.S. Patent Application Ser. No. 62/747,746 filed on Oct. 19, 2018, the entire disclosure of which is incorporated herein by reference.

BACKGROUND OF THE INVENTION

The present invention relates to a protective helmet.

Protective helmets are commonly worn in the workplace to prevent or reduce the likelihood of head injuries. For example, a hard hat is the most common and well-recognized protective helmet. For another example, a fire helmet is another common protective helmet. Such protective helmets, including hard hats and fire helmets, commonly are comprised of an outer shell and a headband, along with a suspension and/or internal shock-absorbing liner, which cooperate to reduce the potential for injury by attenuating some translational energy of the force of an impact to the helmet.

The construction of such protective helmets is further described, for example, in U.S. Pat. Nos. 4,888,831, 6,609,254, 6,862,747, 7,000,262, 7,043,772, 7,174,575, and 7,213,271, each of which is assigned to the present applicant and is incorporated herein by reference.

For a protective helmet to provide the appropriate level of protection, it must fit snugly on the wearer's head. Thus, it is common for the headband of a protective helmet to be adjustable to provide for such a snug fit. In this regard, a headband typically has one of two common sizing mechanisms, a pin-lock arrangement or a ratchet mechanism. Regardless of the chosen sizing mechanism, the headband is commonly a flexible, one-piece member that has overlapping rear end portions.

With a pin-lock arrangement, a first of the rear end portions of the headband is provided with a pin, and the second of the rear end portions is provided with a series of holes at spaced intervals. As such, the pin of the first rear end portion can be inserted through one of the holes of the second rear end portion, thus forming a loop of a selected circumference to fit snugly around the wearer's head.

With a ratchet mechanism, lateral movement of the overlapping rear end portions of the headband is effectuated through a rack and pinion arrangement or similar gear arrangement. For example, a preferred ratchet mechanism is a rack and pinion arrangement which operates within elongated overlapping slots defined by the rear end portions of the headband, each of said slots defining a series of teeth of a rack gear. The rack and pinion arrangement and the overlapping rear end portions of the headband are housed between a pair of adjoining arc-shaped housing sections which generally conform to the contour of the wearer's head. The rear end portions of the headband are seated for slidable, lateral movement within the arc-shaped housing sections.

Nevertheless, it still remains challenging to design a headband for a protective helmet that accommodates a wide range of head sizes and shapes. For example, design challenges include managing excessive tail material (i.e., the rear end portions) and having enough ratchet travel to adjust to extreme sizes.

SUMMARY OF THE INVENTION

The present invention is a headband for a protective helmet, and, more particularly, a headband for accommodating multiple head sizes and/or shapes.

A protective helmet that includes an exemplary headband for accommodating multiple head sizes and/or shapes made in accordance with the present invention is generally comprised of: a substantially rigid shell shaped to protect the wearer's head, with the shell defining a bottom opening and an internal cavity for receiving the wearer's head; the exemplary headband, which is operably connected to the shell; and a shock-absorbing liner positioned in the internal cavity for receiving the wearer's head, i.e., between the shell and the wearer's head. In other embodiments, the protective helmet may also include a suspension (in addition to or as an alternative to the shock-absorbing liner) to reduce the potential for injury by attenuating some translational energy of the force of an impact to the helmet.

The headband includes a front portion which, in use, effectively conforms and is positioned adjacent to the forehead and the respective sides of a user's head. The headband further includes a left rear portion that is selectively connected to the front portion and a right rear portion that is selectively connected to the front portion. The left rear portion and the right rear portion are configured to overlap one another.

The protective helmet also includes a means for securing a position of the left rear portion relative to the right rear portion, for example, a ratchet mechanism. In this regard, each of the left rear portion and the right rear portion of the headband defines an elongated slot and associated rack gear. The ratchet mechanism includes a housing, which defines an internal cavity for receiving the left rear portion and the right rear portion of the headband in an overlapping arrangement. An adjustment mechanism is adapted to cause lateral movement of the left rear portion and the right rear portion of the headband with respect to one another.

Each of the left rear portion and the right rear portion can be readily disconnected from the front portion of the headband and exchanged for an alternative. In other words, different sizes (lengths) of the left rear portion and the right rear portion can be included as part of a kit and selected for use depending on the size of the user's head.

In some embodiments, at one of the distal (or free) ends of the front portion of the headband, there is a cylindrical extension that is adapted to fit in and engage a corresponding opening defined by the left rear portion of the headband, thus connecting the left rear portion of the headband to the front portion of the headband. Similarly, at the other of the distal (or free) ends of the front portion of the headband, there is an identical cylindrical extension that is adapted to fit in and engage a corresponding opening defined by the right rear portion of the headband, thus connecting the right rear portion of the headband to the front portion of the headband. Such connections allow for pivoting movement of each of the left rear portion and the right rear portion relative to the front portion of the headband, which better accommodates different shapes of a user's head.

DETAILED DESCRIPTION OF THE INVENTION

The present invention is a headband for a protective helmet, and, more particularly, a headband for accommodating multiple head sizes and/or shapes.

Figure 1:
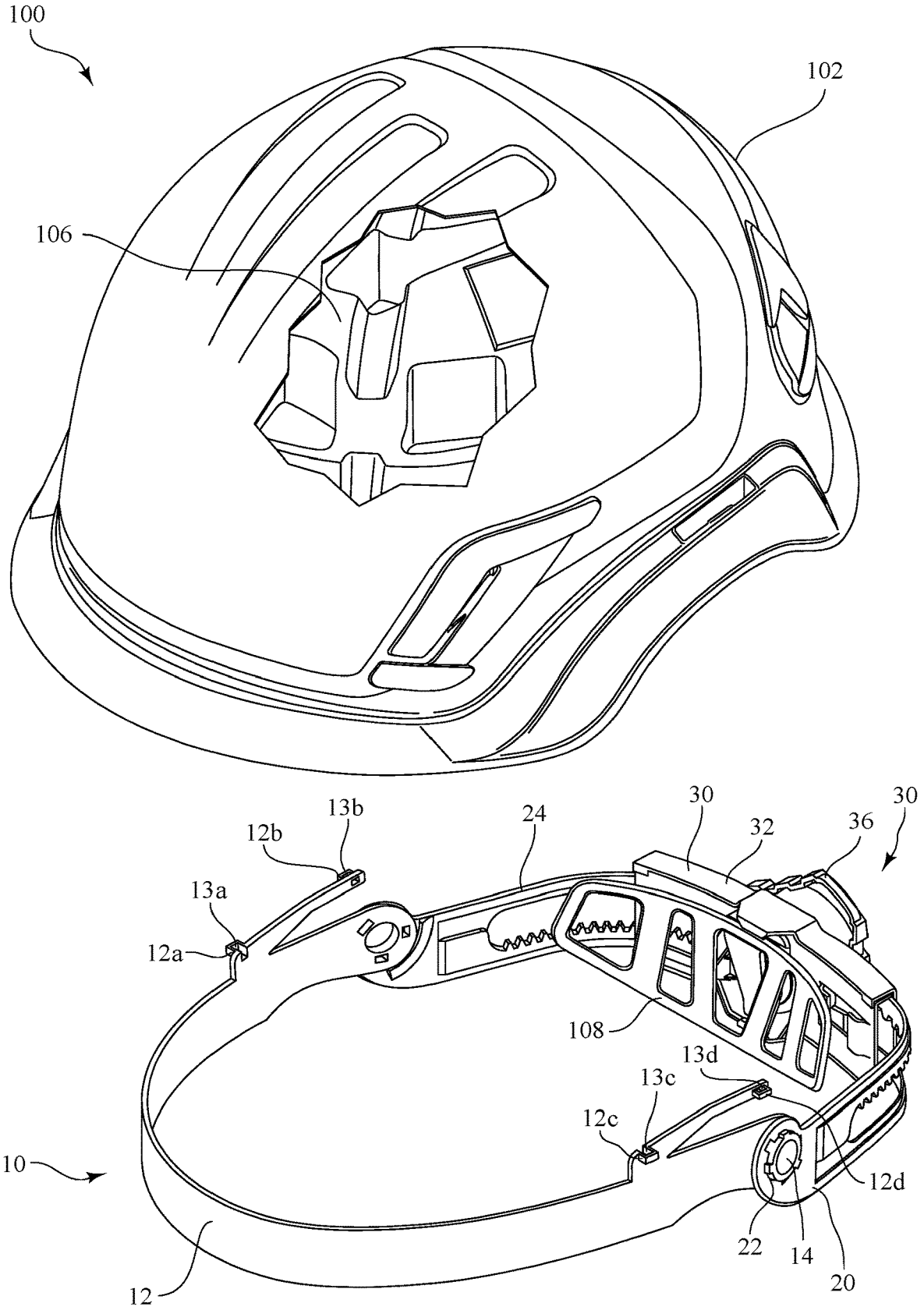
FIG. 1 is a perspective view of a protective helmet that includes an exemplary headband for accommodating multiple head sizes and/or shapes made in accordance with the present invention.

FIG. 1 is a perspective view of a protective helmet 100 that includes an exemplary headband 10 for accommodating multiple head sizes and/or shapes made in accordance with the present invention. As shown in FIG. 1, in this exemplary embodiment, the protective helmet 100 is generally comprised of: a substantially rigid shell 102 shaped to protect the wearer's head, with the shell 102 defining a bottom opening and an internal cavity for receiving the wearer's head; the exemplary headband 10, which is operably connected to the shell 102; and a shock-absorbing liner 106 positioned in the internal cavity for receiving the wearer's head, i.e., between the shell 102 and the wearer's head. As noted above, in other embodiments, the protective helmet 100 may also include a suspension (in addition to or as an alternative to the shock-absorbing liner) to reduce the potential for injury by attenuating some translational energy of the force of an impact to the helmet. In any event, in the exemplary embodiment shown in FIG. 1, the headband 10 is configured for direct attachment to the shell 102 of the protective helmet 100. Specifically, the front portion 12 of the headband 10 includes multiple integral tabs 12*a-d*, which define cavities 13*a*-13*d* that mate with corresponding integral projections (not shown) that extend from the underside of the shell 102 of the protective helmet 100. Of course, screws or other conventional fasteners could also be used to secure the headband 10 to the shell 102 of the protective helmet 100 without departing from the spirit and scope of the present invention.

Figure 2:
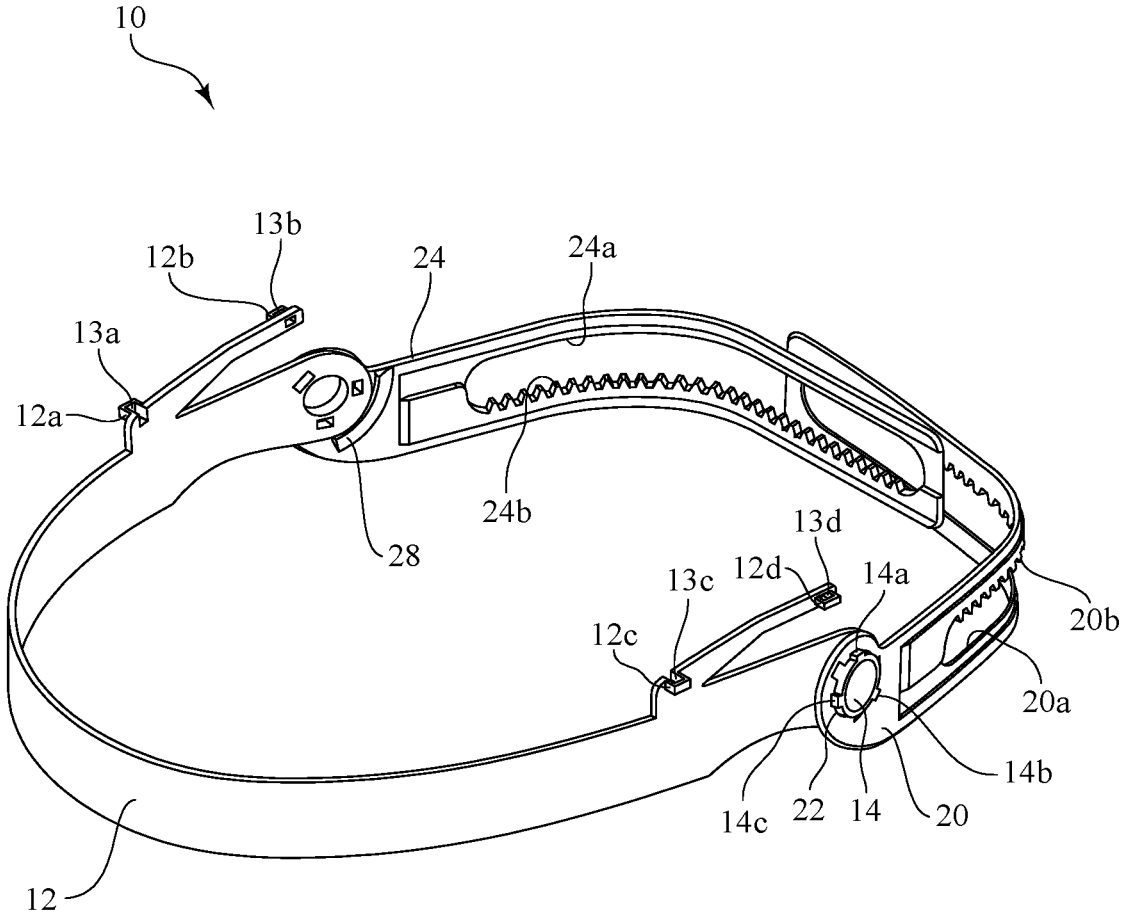
FIG. 2 is a perspective view of the exemplary headband of FIG. 1.

FIG. 2 is a perspective view of the exemplary headband 10. As shown in FIG. 2, the headband 10 includes a front portion 12 which, in use, effectively conforms and is positioned adjacent to the forehead and the respective sides of a user's head. The headband 10 further includes a left rear portion 20 that is selectively connected to the front portion 12 and a right rear portion 24 that is selectively connected to the front portion 12. The left rear portion 20 and the right rear portion 24 are configured to overlap one another.

Referring again to FIG. 1, the protective helmet 100 also includes a means for securing a position of the left rear portion 20 relative to the right rear portion 24. In this exemplary embodiment, the means is a ratchet mechanism 30. Referring again to FIG. 2, each of the left rear portion 20 and the right rear portion 24 of the headband 10 defines an elongated slot 20*a*, 24*a* and associated rack gear 20*b*, 24*b*. Referring again to FIG. 1, the ratchet mechanism 30 includes a housing 32, which is comprised of an outer substantially arc-shaped housing section joined to an inner substantially arc-shaped housing section, which collectively define an internal cavity for receiving the left rear portion 20 and the right rear portion 24 of the headband 10 in an overlapping arrangement. An adjustment mechanism is adapted to cause lateral movement of the left rear portion 20 and the right rear portion 24 of the headband 10 with respect to one another. The operation of such a ratchet mechanism is described above and in further detail, for example, in the aforementioned U.S. Pat. Nos. 4,888,831; 7,000,262; 7,043,77; and 7,174,575, which are incorporated herein by reference.

As mentioned above, in other embodiments, the means for securing a position of the left rear portion 20 relative to the right rear portion 24 could be a pin-lock arrangement, with one of the left rear portion 20 and the right rear portion 24 being provided with a pin, and the other of the left rear portion 20 and the right rear portion 24 being provided with a series of holes at spaced intervals. As such, the pin can be inserted through a selected one of the holes, thus forming a loop of a selected circumference to fit snugly around the wearer's head.

Figure 3:
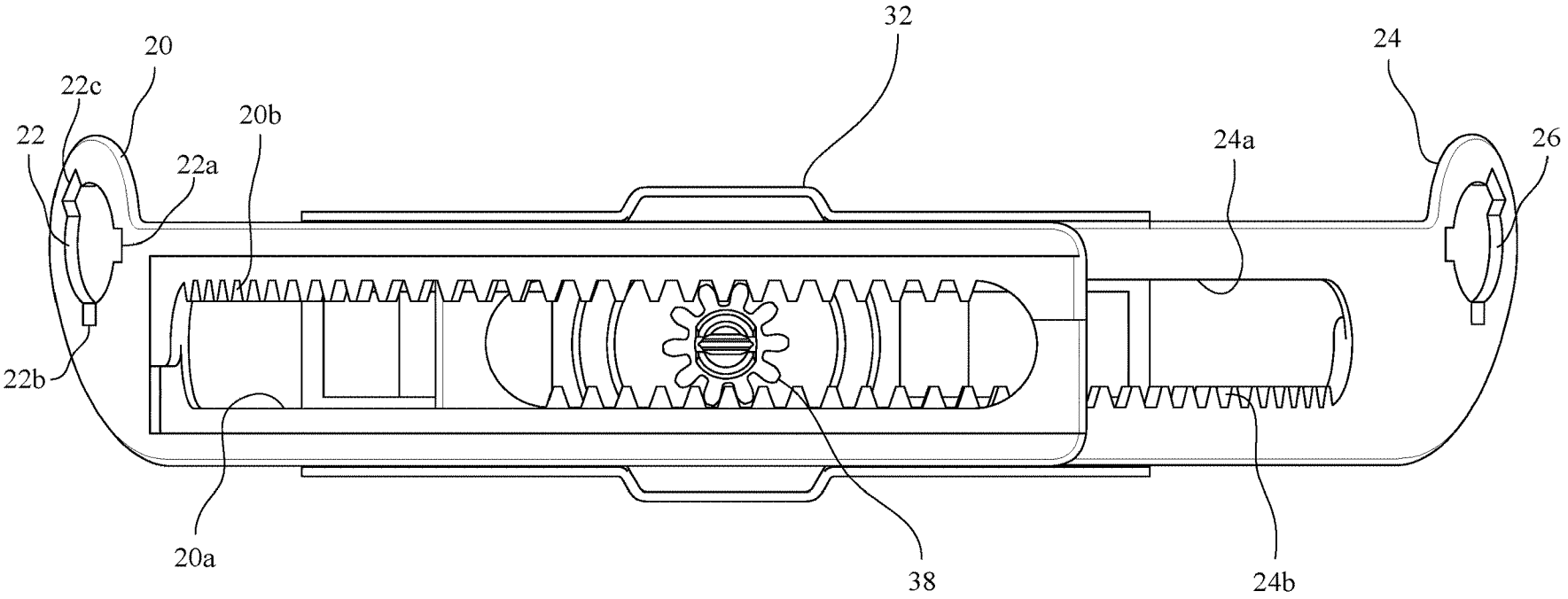
FIG. 3 is a rear view of the exemplary headband of FIG. 1, along with a portion of the adjustment mechanism adapted to cause lateral movement of the left rear portion and the right rear portion of the headband with respect to one another.

Referring still to FIG. 1, along with the rear view of the headband 10 in FIG. 3, the adjustment mechanism includes an adjustment knob 36 which is positioned on an exterior side of the housing 32 (FIG. 1), and a pinion 38 which is positioned in the internal cavity defined by the housing 32 (FIG. 3). The adjustment knob 36 and the pinion 38 may be separate components that are operably connected to one another, or the adjustment knob 36 and the pinion 38 could be a unitary component. In any event, the pinion 38 is adapted to mate with and engage the respective rack gears 20*b*, 24*b* of the left rear portion 20 and the right rear portion 24 of the headband 10, such that rotation of the adjustment knob 36 results in rotation of the pinion 38 and causes lateral movement of the left rear portion 20 and right rear portion 24 with respect to one another.

Figure 4:
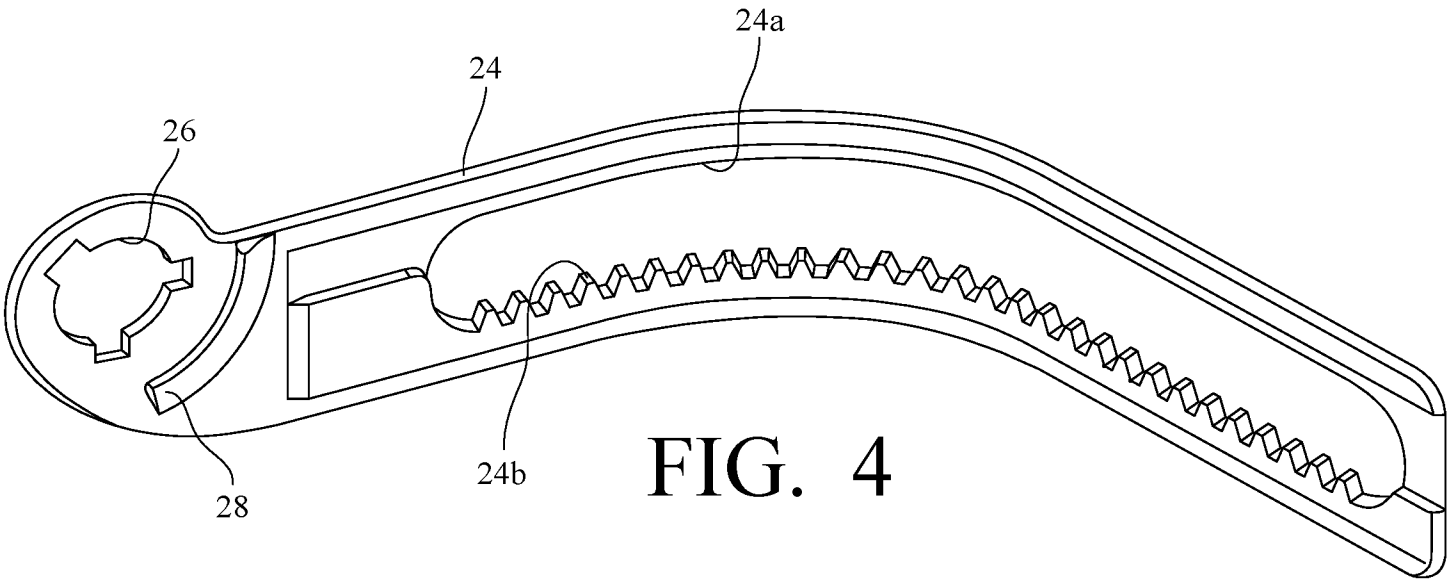
FIG. 4 is a perspective view of the right rear portion of the headband of FIG. 2.
Figure 5:
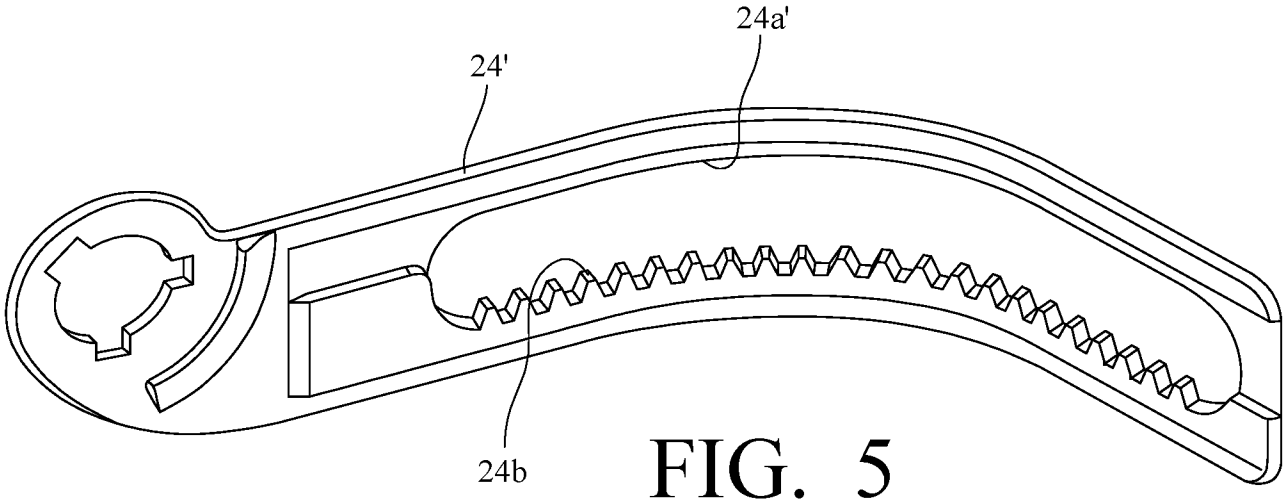
FIG. 5 is a perspective view of an alternate right rear portion of the headband of FIG. 2.

More importantly, each of the left rear portion 20 and the right rear portion 24 can be readily disconnected from the front portion 12 of the headband 10 and exchanged for an alternative. In other words, different sizes (lengths) of the left rear portion 20 and the right rear portion 24 can be included as part of a kit and selected for use depending on the size of the user's head. For example, FIG. 4 is a perspective view of the right rear portion 24 of the headband 10, which is a "large size," and FIG. 5 is a perspective view of an alternate "small size" of a right rear portion 24' of the headband 10 (which similarly defines an elongated slot 24*a*' and associated rack gear 24*b*'. Of course, in each case, the left rear portion 20 would preferably correspond in size to the selected right rear portion 24, 24'.

As best shown in FIG. 2, in this exemplary embodiment, at one of the distal (or free) ends of the front portion 12 of the headband 10, there is a cylindrical extension 14 that is adapted to fit in and engage a corresponding opening 22 defined by the left rear portion 20 of the headband 10, thus connecting the left rear portion 20 of the headband 10 to the front portion 12 of the headband 10. Similarly, at the other of the distal (or free) ends of the front portion 12 of the headband 10, there is an identical cylindrical extension (not shown) that is adapted to fit in and engage a corresponding opening 26 (shown in FIGS. 3 and 4) defined by the right rear portion 24 of the headband 10, thus connecting the right rear portion 24 of the headband 10 to the front portion 12 of the headband 10. Such connections allow for pivoting movement of each of the left rear portion 20 and the right rear portion 24 relative to the front portion 12 of the headband 10, which better accommodates different shapes of a user's head.

Referring still to FIG. 2, in this exemplary embodiment, the cylindrical extension 14, which is at one of the distal (or free) ends of the front portion 12 of the headband 10 and is adapted to fit in and engage the corresponding opening 22 defined by the left rear portion 20 of the headband 10, has three radial tabs 14*a*, 14*b*, 14*c* at spaced intervals about the periphery of the cylindrical extension 14. The opening 22 defined by the left rear portion 20 of the headband 10 includes three corresponding notches 22*a*, 22*b*, 22*c* (shown in FIG. 3) at spaced intervals about the periphery of the opening 22. Thus, to connect the left rear portion 20 of the headband 10 to the front portion 12, the radial tabs 14*a*, 14*b*, 14*c* of the cylindrical extension 14 are aligned with the corresponding notches 22*a*, 22*b*, 22*c* of the opening 22. The cylindrical extension 14 is then advanced into the opening 22 until the radial tabs 14*a*, 14*b*, 14*c* clear the opening 22. The cylindrical extension 14 is then rotated, such that the radial tabs 14*a*, 14*b*, 14*c* of the cylindrical extension 14 are no longer aligned with the corresponding notches 22*a*, 22*b*, 22*c* of the opening 22. In this regard, the radial tabs 14*a*, 14*b*, 14*c* are essentially "undercut," so that the radial tabs 14*a*, 14*b*, 14*c* extend over the edge of the opening 22 when not aligned with the corresponding notches 22*a*, 22*b*, 22*c*. The left rear portion 20 of the headband 10 is thus connected to the front portion 12, and the left rear portion 20 can pivot relative to the front portion 12 through the rotation of the cylindrical extension 14 relative to the opening 22.

In some exemplary embodiments, the radial tabs 14*a*, 14*b*, 14*c* of the cylindrical extension 14 and the corresponding notches 22*a*, 22*b*, 22*c* of the opening 22 are spaced relative to one another in a manner which required the cylindrical extension 14 and the opening 22 to be aligned in a single, specific orientation before the left rear portion of the headband 10 can be connected to the front portion 12.

Of course, it is contemplated and preferred that the left rear portion 20 and the right rear portion 24 have substantially identical constructions, and thus, the right rear portion 24 of the headband 10 is connected to the front portion 12 in the same manner as the left rear portion 20, as described above.

As a further refinement, in this exemplary embodiment, and as shown in FIG. 2, a rib element 28 projects from the inner surface of the right rear portion 24 of the headband 10 and acts as a rotational stop, with the distal edge of the right rear portion 24 of the headband 10 abutting the rib element 28. Furthermore, the rib element 28 helps prevent items, such as hair or head coverings, from being caught in the connection between the front portion 12 and the right rear portion 24 of the headband 10. Again, since the left rear portion 20 and the right rear portion 24 have substantially identical constructions, a similar rib element (not shown) preferably projects from the inner surface of the left rear portion 20 of the headband 10.

As a further refinement, in this exemplary embodiment, and as also shown in FIG. 2, the protective helmet 100 also includes a nape cup 108 that is mounted to the housing 32 of the ratchet mechanism 30, so that it can pivot up and down about a substantially horizontal axis, which further improves the fit of the protective helmet 100.

Finally, although not shown in the drawings, it should also be appreciated such ready exchange of the left rear portion 20 and/or the right rear portion 24 of the headband 10 can also allow for field upgrades and the attachment of an alternate ratchet mechanism or other means for securing a position of the left rear portion 20 relative to the right rear portion 24. Furthermore, it also allows for the attachment of other accessories, such as a fan, tail light, or haptic alert system.

One of ordinary skill in the art will recognize that additional embodiments are also possible without departing from the teachings of the present invention. This detailed description, and particularly the specific details of the exemplary embodiment disclosed therein, is given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A headband for a protective helmet, comprising:

a front portion configured to be secured to the protective helmet;

a left rear portion that is selectively connected to the front portion;

a right rear portion that is selectively connected to the front portion and is configured to overlap the left rear portion; and a means for securing a position of the left rear portion relative to the right rear portion;

wherein, at one distal end of the front portion of the headband, there is a cylindrical extension that is adapted to fit in and engage a corresponding opening defined by the left rear portion of the headband, thus connecting the left rear portion of the headband to the front portion of the headband; and wherein, at another distal end of the front portion of the headband, there is a cylindrical extension that is adapted to fit in and engage a corresponding opening defined by the right rear portion of the headband, thus connecting the right rear portion of the headband to the front portion of the headband.

2. The headband as recited in claim 1, wherein the means for securing the position of the left rear portion relative to the right rear portion is a ratchet mechanism, wherein each of the left rear portion and the right rear portion of the headband defines an elongated slot and associated rack gear, wherein a housing defines an internal cavity for receiving the left rear portion and the right rear portion of the headband in an overlapping arrangement, and wherein an adjustment mechanism is adapted to cause lateral movement of the left rear portion and the right rear portion of the headband with respect to one another.

3. The headband as recited in claim 2, wherein the adjustment mechanism includes a pinion which is adapted to mate with and engage the respective rack gears of the left rear portion and the right rear portion of the headband, and a knob operably connected to the pinion, such that rotation of the knob results in rotation of the pinion and causes lateral movement of the left rear portion and the right rear portion of the headband with respect to one another.

4. The headband as recited in claim 1, wherein each cylindrical extension has multiple radial tabs at spaced intervals about a periphery of the cylindrical extension, and wherein each of the respective openings defined by the left rear portion and the right rear portion of the headband includes corresponding notches at spaced intervals about a periphery of the respective opening, thus facilitating connection of each of the left rear portion and the right rear portion of the headband to the front portion of the headband via alignment of the multiple radial tabs with the corresponding notches.

5. The headband as recited in claim 1, wherein the left rear portion of the headband pivots relative to the front portion of the headband through rotation of the cylindrical extension relative to the corresponding opening.

6. A headband kit for a protective helmet, comprising:

a front portion configured to be secured to the protective helmet;

multiple left rear portions, each of which can be selectively connected to the front portion; and multiple right rear portions, each of which can be selectively connected to the front portion;

wherein, at one distal end of the front portion, there is a cylindrical extension that is adapted to fit in and engage a corresponding opening defined by a selected one of the multiple left rear portions, thus connecting the selected one of the multiple left rear portions to the front portion; and wherein, at another distal end of the front portion, there is a cylindrical extension that is adapted to fit in and engage a corresponding opening defined by a selected one of the multiple right rear portions, thus connecting the selected one of the multiple right rear portions to the front portion.

7. The headband kit for a protective helmet as recited in claim 6, and further comprising a means for securing a selected one of the multiple left rear portions to a selected one of the multiple right rear portions.

8. The headband kit for a protective helmet as recited in claim 7, wherein the means for securing a selected one of the multiple left rear portions to a selected one of the multiple right rear portions is a ratchet mechanism, wherein each of the multiple left rear portions and each of the multiple right rear portions defines an elongated slot and associated rack gear, wherein a housing defines an internal cavity for receiving the selected one of the multiple left rear portions and the selected one of the multiple right rear portions in an overlapping arrangement, and wherein an adjustment mechanism is adapted to cause lateral movement of the selected one of the multiple left rear portions and the selected one of the multiple right rear portions with respect to one another.

9. The headband kit for a protective helmet as recited in claim 8, wherein the adjustment mechanism includes a pinion which is adapted to mate with and engage the respective rack gears of the selected one of the multiple left rear portions and the selected one of the multiple right rear portions, and a knob operably connected to the pinion, such that rotation of the knob results in rotation of the pinion and causes lateral movement of the selected one of the multiple left rear portions and the selected one of the multiple right rear portions with respect to one another.

10. A protective helmet adapted to receive and protect a wearer's head, comprising:

a shell shaped to protect the wearer's head, the shell defining a bottom opening and an internal cavity for receiving the wearer's head; and a headband operably connected to the shell, including a front portion operably connected to the shell, a left rear portion that is selectively connected to the front portion, a right rear portion that is selectively connected to the front portion and is configured to overlap the left rear portion, and a means for securing a position of the left rear portion relative to the right rear portion, wherein, at one distal end of the front portion of the headband, there is a cylindrical extension that is adapted to fit in and engage a corresponding opening defined by the left rear portion of the headband, thus connecting the left rear portion of the headband to the front portion of the headband, and wherein, at another distal end of the front portion of the headband, there is a cylindrical extension that is adapted to fit in and engage a corresponding opening defined by the right rear portion of the headband, thus connecting the right rear portion of the headband to the front portion of the headband.

11. The protective helmet as recited in claim 10, wherein the means for securing the position of the left rear portion relative to the right rear portion is a ratchet mechanism, wherein each of the left rear portion and the right rear portion of the headband defines an elongated slot and associated rack gear, wherein a housing defines an internal cavity for receiving the left rear portion and the right rear portion of the headband in an overlapping arrangement, and wherein an adjustment mechanism is adapted to cause lateral movement of the left rear portion and the right rear portion of the headband with respect to one another.

12. The protective helmet as recited in claim 11, wherein the adjustment mechanism includes a pinion which is adapted to mate with and engage the respective rack gears of the left rear portion and the right rear portion of the headband, and a knob operably connected to the pinion, such that rotation of the knob results in rotation of the pinion and causes lateral movement of the left rear portion and the right rear portion of the headband with respect to one another.

13. The protective helmet as recited in claim 10, and further comprising a shock-absorbing liner positioned in the internal cavity.

14. The protective helmet as recited in claim 10, wherein the headband is directly attached to the shell.

15. The protective helmet as recited in claim 14, wherein the front portion of the headband includes multiple tabs, which each define cavities that mate with corresponding projections that extend from an underside of the shell.

16. The protective helmet as recited in claim 10, wherein each cylindrical extension has multiple radial tabs at spaced intervals about a periphery of the cylindrical extension, and wherein each of the respective openings defined by the left rear portion and the right rear portion of the headband includes corresponding notches at spaced intervals about a periphery of the respective opening, thus facilitating connection of each of the left rear portion and the right rear portion of the headband to the front portion of the headband via alignment of the multiple radial tabs with the corresponding notches.

17. The protective helmet as recited in claim 10, wherein the left rear portion of the headband pivots relative to the front portion of the headband through rotation of the cylindrical extension relative to the corresponding opening.

* * * * *